US006564907B1

(12) United States Patent
Sasaki

(10) Patent No.: US 6,564,907 B1
(45) Date of Patent: May 20, 2003

(54) ELEVATOR HAVING EMERGENCY STOP DEVICE

(75) Inventor: Hirotada Sasaki, Tokyo (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/390,658

(22) Filed: Sep. 7, 1999

(30) Foreign Application Priority Data

Sep. 7, 1998 (JP) ..... 10-252681

(51) Int. Cl.[7] ..... B66B 5/00; B66B 5/04; B66B 1/28

(52) U.S. Cl. ..... 187/373; 187/287; 187/286; 187/298; 187/305

(58) Field of Search ..... 187/266, 286, 187/287, 288, 298, 305, 306, 350, 351, 373, 375, 377

(56) References Cited

U.S. PATENT DOCUMENTS 1,258,127 A * 3/1918 Lindstrom ..... 187/375
1,977,452 A * 10/1934 Neuschotz ..... 187/375
1,987,719 A * 1/1935 Sprague ..... 187/375
2,031,043 A * 2/1936 Hymans ..... 187/375
2,326,046 A * 8/1943 McCormick ..... 187/375 X
2,581,297 A * 1/1952 Rissler ..... 187/375
3,346,074 A * 10/1967 Borden et al. ..... 187/375
5,020,640 A * 6/1991 Nederbragt ..... 187/373 X
5,565,660 A * 10/1996 Karner ..... 187/373 X
5,878,847 A * 3/1999 Mustalahti et al. ..... 187/266 X
5,899,300 A * 5/1999 Miller et al. ..... 187/266 X
5,899,301 A * 5/1999 Aulanko et al. ..... 187/266
5,971,109 A * 10/1999 Aulanko et al. ..... 187/350 X

FOREIGN PATENT DOCUMENTS

FI 101783 B 8/1998
JP 6-256279 9/1994

OTHER PUBLICATIONS

European Search Report.

* cited by examiner

*Primary Examiner*—Douglas Hess
*Assistant Examiner*—Thuy V. Tran
(74) *Attorney, Agent, or Firm*—Oblon, Spivak, McClelland, Maier & Neustadt, P.C.

(57) ABSTRACT

An elevator including a cage configured to ascend and descend along a guide rail in an elevator shaft, a drive unit configured to move the cage up and down, and an emergency stop device configured to urgently stop the cage when the cage descends at an extraordinary speed. The emergency stop device including an emergency stop mechanism provided at a lower end portion of the cage and configured to engage the guide rail, thereby urgently stopping the cage, a link mechanism provided at the lower end portion of the cage so as to be located close to the emergency stop mechanism and configured to actuate the emergency stop mechanism on receiving an external input, and a speed detector configured to detect the descent of the cage at the extraordinary speed and correspondingly to apply the external input to the link mechanism.

10 Claims, 6 Drawing Sheets

ELEVATOR HAVING EMERGENCY STOP DEVICE

CROSS REFERENCE TO RELATED APPLICATION

This application claims benefit of priority to Japanese Patent Application No. JP10-252681 filed Sep. 7, 1998, the entire disclosure of which is incorporated by reference herein.

BACKGROUND OF THE INVENTION

1. Field of the Invention

The present invention relate, to an elevator provided with an emergency stop device.

2. Description of the Background

A conventional elevator apparatus is composed of an elevator shaft extending vertically in a building, and a machine room (penthouse) located right over the shaft and having a motor and the like. This elevator apparatus further includes a sheave located in the machine room and driven by the motor, a cage disposed in the shaft and connected to one portion of a cable that is wound on the sheave, and a counterweight connected to another portion of the cable and balanced with the cage. The cage is moved up and down by rotating the sheave in the machine room. The cage and the counterweight are guided by means of guide rails arranged in the elevator shaft.

With the increased construction of high-rise buildings, the operating speed of elevators is becoming higher and higher, thus requiring a satisfactory safe measure. To cope with this, the conventional elevator apparatus is provided with an emergency stop device that can stop the cage safely and securely in case the cage for any reason suddenly descends at a speed higher than its rated speed. One example of the emergency stop device is disclosed in U.S. Pat. No. 5,377,786.

The emergency stop device is composed of a governor, a cable passed through the governor and adapted to be restricted in motion when the cage descends at a speed higher than its rated speed, and a stop mechanism attached to the cage and capable of braking and stopping the cage. The stop device further has a link mechanism, which connects the cable and the stop mechanism and actuates the stop mechanism through the medium of the relative movements of the cable and the cage when the cable is restricted in motion.

The emergency stop mechanism, which is located at the lower end portion of the cage, includes a holding member having a V-shaped slit gradually spreading downward and a stopper member slidable in the slit. The emergency stop device brakes the cage in a manner such that the stopper member moves up to cause each guide rail to be held tight in the slit of the holding member by an wedge effect.

The link mechanism includes a driving lever, which is attached to the upper part of the cage and fixed to the cable extending from the governor, and a lift rod connecting the driving lever and the slit member of the stop mechanism. The lift rod extends along the height direction of the cage, and serves to pull up the slit member of the stop mechanism at the lower end of the cage thereby actuating the stop mechanism.

Further, the link mechanism is provided with a limit switch, which detects the actuation of the link mechanism and outputs a hoisting machine stop command signal. Once the limit switch detects a shift of the driving lever and delivers the stop command signal to a control device, it continues to output the command signal.

In canceling an emergency stop state and restarting the elevator apparatus, the guide rail is released from the hold in the slit by means of the stopper member by, for example, pulling up the cage, whereby the restraint on the ascent and descent of the cage by the emergency stop device is removed. An operator gets on the cage and manually resets the limit switch to its initial state, thereby enabling the elevator apparatus to be restarted.

In the conventional elevator apparatus described above, the link mechanism is attached to the upper end portion of the cage, so that a relatively long member is used as the lift rod for connecting the stopper member of each emergency stop device and the driving lever. It is difficult, therefore, to keep the lift-mechanism in an assembled state when it is shipped from the factory. Thus, the lift mechanism must be assembled during installation of the elevator in the building.

Since the elevator shaft is relatively narrow, assembling the link mechanism in the building requires much time and labor. Since the lift rod is a relatively long member, moreover, each link mechanism must be finely adjusted as it is assembled, in order to assure normal operation. Thus, the installation work entails high costs.

If the link mechanism is attached to the lower end portion of the cage with the lift rod shortened so that the mechanism can be in the assembled state as it is shipped from the factory, furthermore, the limit switch must be also attached to the lower end portion of the cage.

If the limit switch is attached to the lower end portion of the cage, it is difficult for the operator to reset the limit switch manually to the initial state in restarting the elevator apparatus after once actuating the emergency stop device. Thus, the elevator apparatus cannot be restarted with ease.

SUMMARY OF THE INVENTION

Accordingly, one object of the present invention is to provide an elevator characterized by reduced installation costs and the like.

Another object of this invention is to provide an elevator apparatus capable of being easily restarted after an emergency stop device is once actuated to restrain a cage from ascending or descending.

These and other objects are achieved according to the present invention by providing a novel elevator including a cage configured to ascend and descend along a guide rail in an elevator shaft, a drive unit for moving the cage up and down, and an emergency stop device configured to urgently stop the cage when the cage descends at an extraordinary speed and including an emergency stop mechanism provided at a lower end portion of the cage and configured to engage the guide rail, thereby urgently stopping the cage, a link mechanism provided at the lower end portion of the cage so as to be located close to the emergency stop mechanism and configured to actuate the emergency stop mechanism on receiving an external input, and a speed detector configured to detect the descent of the cage at the extraordinary speed and correspondingly to apply the external input to the link mechanism.

BRIEF DESCRIPTION OF THE DRAWING

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE INVENTION

Figure 1A:
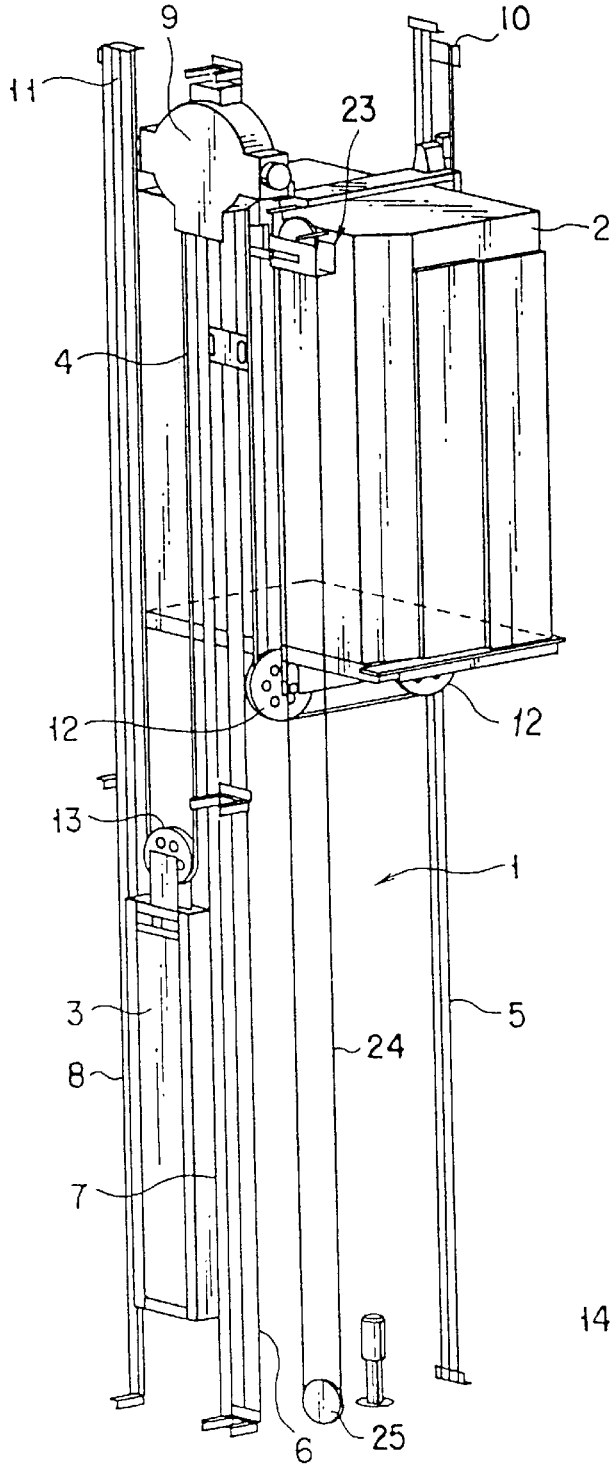
FIG. 1A is a schematic view showing an elevator according to an embodiment of the present invention.

Referring now to the drawings, where like reference numerals designate the same or corresponding parts throughout the several views, and more particularly to FIG. 1A the general construction of a machine-room-less elevator according to the present invention will be described.

As shown in FIG. 1A, in an elevator shaft 1 provided in a building, a cage 2 and a counterweight 3 are suspended and balanced by means of a cable 4. Guide rails 5 and 6 for vertically guiding the cage 2 are arranged on the right- and left-hand sides, respectively, of the shaft 1, while counterweight guide rails 7 and 8 for guiding the counterweight 3 for up-and-down motion are arranged behind the left-hand guide rail 6.

On the left-hand side of the upper part of the interior of the elevator shaft 1, a drive unit 9 (a hoisting device or traction machine) is set in a narrow space between an inner wall of the shaft 1 and a side wall of the cage 2. The drive unit 9, which is fixed to the guide rails 6 and 7, can wind up the cable 4, thereby relatively moving the cage 2 and the counterweight 3 up and down. The drive unit 9 may be fixed to the guide rails 7 or 8.

One end portion of the cable 4, which is wound up by the drive unit 9, is fixed to a cable hitch 10 that is attached to the upper end portion of the guide rail 5, while the other end portion is fixed to a cable hitch 11 that is attached to the upper end portion of the counterweight guide rail 8. The middle portion of the cable 4 is passed around lower sheaves 12 that are attached to the lower part of the cage 2, extends through the drive unit 9, and is then passed around a counterweight sheave 13 that is attached to the upper part of the counterweight 3.

Figure 1B:
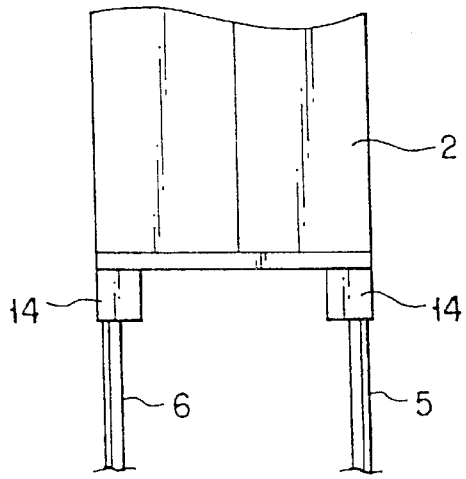
FIG. 1B is a front view showing the lower end portion of a cage.

As shown in FIG. 1B, emergency stop mechanisms 14 are provided on the bottom portion of the cage 2. The emergency stop mechanisms 14 serve to stop the cage 2 safely and securely in case the cage 2 suddenly falls at a speed higher than its rated speed for any reason. As described in detail later, the emergency stop mechanisms 14 brake and compulsorily stop the cage 2 in a manner such that stopper members are driven like wedges between the cage 2 and the guide rails 5 and 6.

Referring now to FIG. 2, there will be described an arrangement of an emergency stop device 20 that includes the emergency stop mechanisms 14.

The emergency stop device 20 is composed of a governor 23 held on the guide rails 5 or 6 for the cage 2 by means of a bracket or the like in the elevator shaft 1, an endless cable 24 passed around a sheave 22 of the governor 23 and a tensioner 25 attached to the lower end of the cable 24 and capable of applying a predetermined tension to the cable 24. The device 20 further has a link mechanism 28, which is attached to the lower end portion of the cage 2 and connects the cable 24 and the emergency stop mechanisms 14, and a limit switch 29 for detecting a stop state produced by the operation of the link mechanism 28.

In normal operation, as the cage 2 ascends or descends, the cable 24, which is connected to the cage 2 by means of the link mechanism 28, moves at the same speed as the cage 2, whereupon the sheave 22 of the governor 23 rotates. If the cage 2 descends at an extraordinary speed from any cause, however, the governor 23 is actuated to restrain the action of the cable 24.

Thereupon, one end portion of the link mechanism 28 is pulled up relatively, so that the emergency stop mechanisms 14 are actuated.

Figure 5:
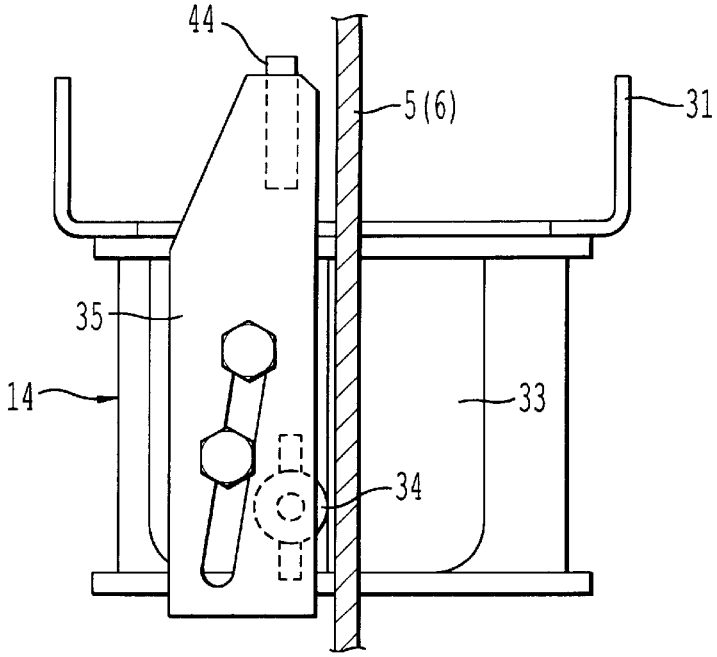
FIG. 5 is a side view showing an emergency stop device according to the first embodiment.
Figure 6:
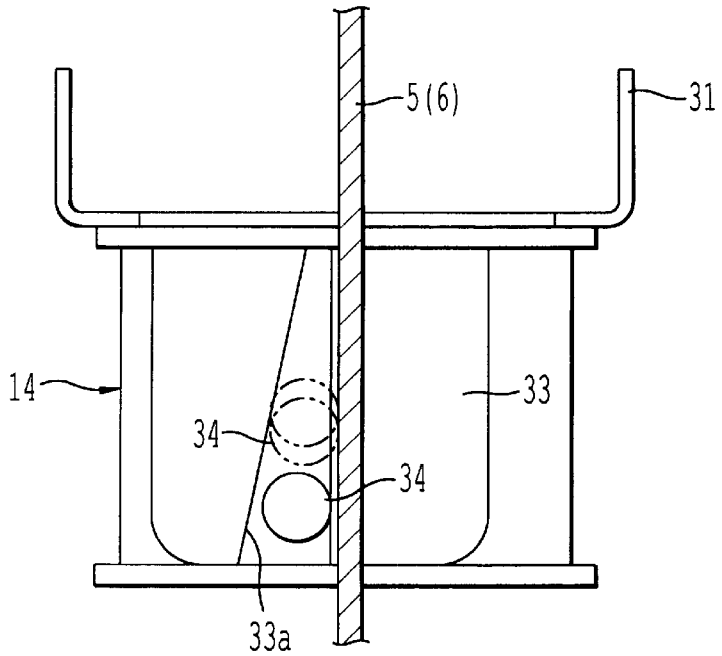
FIG. 6 is a side view illustrating operation of the emergency stop device shown in FIG. 5.

FIGS. 5 and 6 are enlarged views showing one of the emergency stop mechanisms 14.

The emergency stop mechanism 14 includes a holding member 33, which is attached to a support base 31 on the lower end of the cage 2 and has an inverted V-shaped slit 33*a* opens downwardly. The guide rail 5 (or 6) is passed through the slit 33*a* of the member 33. A stopper member 34 is caught between the slit 33*a* and the guide rail 5 so that the cage 2 is braked on the rail 5 by an wedge effect. The stopper member 34 is held by a support member 35 shown in FIG. 5. Braking action is caused by pulling up the support member 35 by means of the link mechanism 28.

Figure 2A:
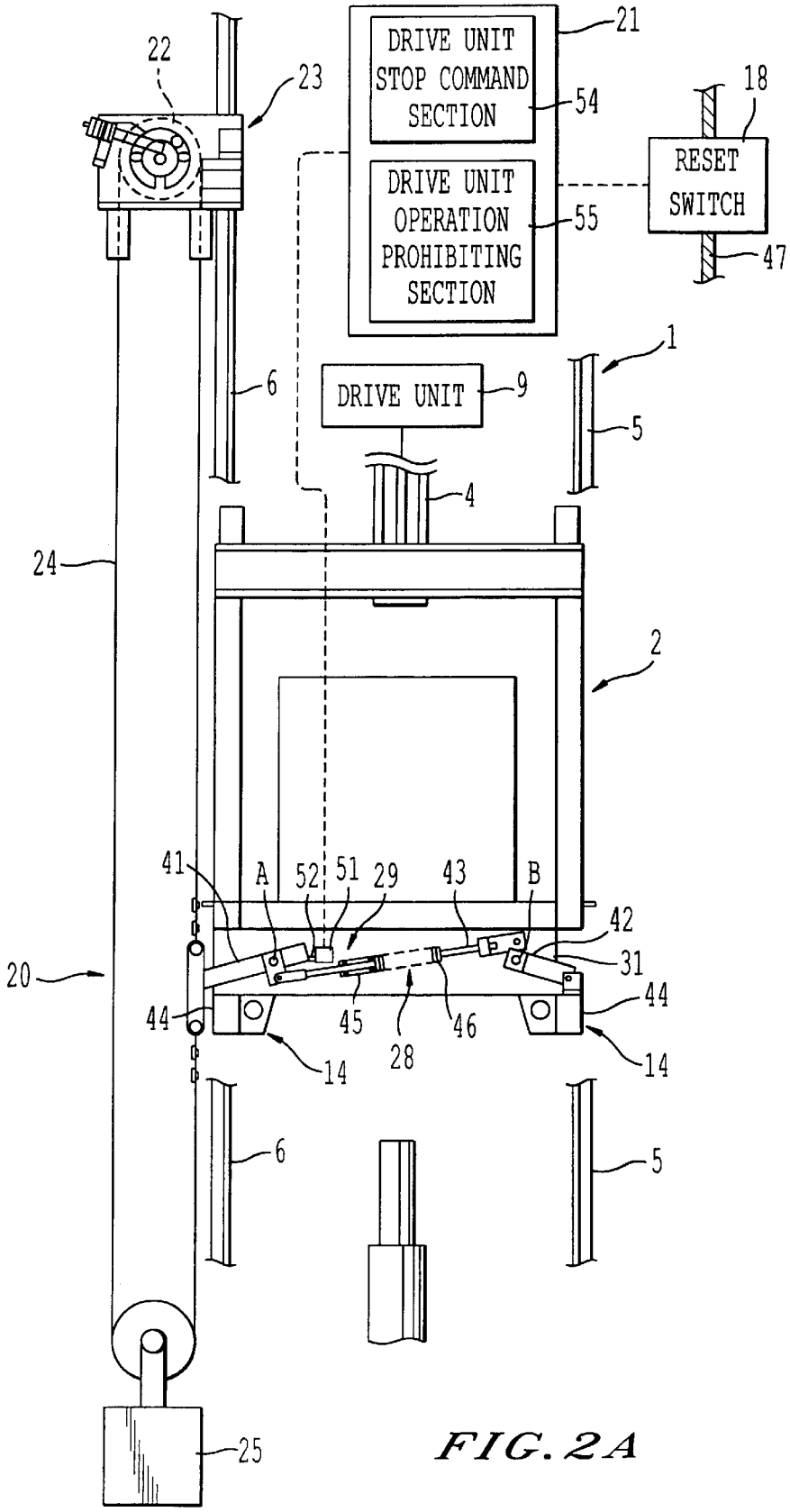
FIG. 2A is a view showing an arrangement of an elevator apparatus according to a first embodiment of the invention and FIG. 2B is a view of a modification of the first embodiment in which the reset switch 18 is located at an upper end portion of the cage.
Figure 3:
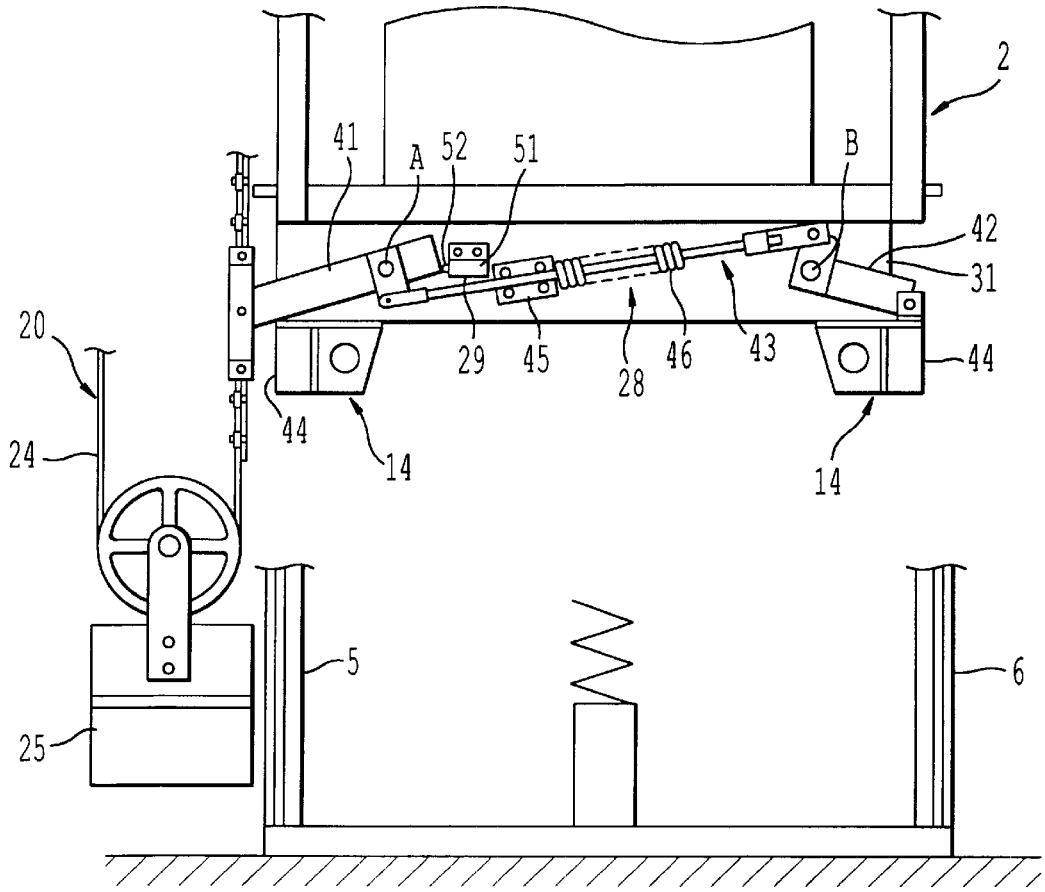
FIG. 3 is a side view showing a portion of the emergency stop device of the elevator apparatus according to the first embodiment.

As shown in FIGS. 2A and 3, the link mechanism 28 is composed of a driving lever 41 that is fixed to the cable 24 for actuating the one emergency stop mechanism 14, a drive lever 42 that is connected to the lever 41 by means of a connecting rod 43 for actuating the other emergency stop mechanism 14, and relatively short connecting members 44 connecting the levers 41 and 42 and the respective support members 35 of the two emergency stop mechanisms 14.

The driving lever 41 and the driven lever 42 are rockable in the vertical direction around points A and B, respectively. The connecting rod 43, which connects the levers 41 and 42, is allowed only to move in its axial direction by a guide member 45 that is fixed to the support base 31. Inserted in the axial middle portion of the rod 43, moreover, is a spring 46 for urging the levers 41 and 42 to lower the connecting members 44 (in a direction so as not to actuate the emergency stop mechanisms 14).

Figure 4:
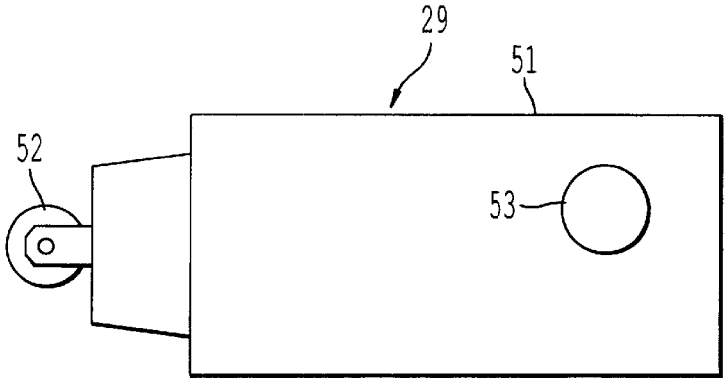
FIG. 4 is a side view showing a limit switch according to the first embodiment.

As shown in FIG. 4, the limit switch 29, which is attached to the link mechanism 28, includes a switch body 51 and a contact 52 that can project from and draw back into the body 51. In an initial state, the contact 52 projects from the switch body 51. The limit switch 29 is mounted on the support base 31 in a manner such that the contact 52 touches the driving lever 41 in the initial state. As the lever 41 rocks, the contact 52 of the switch 29 projects from or draws back into the switch body 51.

The limit switch 29 is connected to a control device 21 shown in FIG. 2A. When the contact 52 recedes for a predetermined displacement or farther, the switch 29 delivers a stop command signal for the drive unit 9 to the control device 21. Preferably, the predetermined displacement of the contact 52 by which the switch 29 outputs the stop command signal should be a displacement obtained immediately before the stopper member 34 comes into contact with the inner surface of the slit 22*a* of the holding member 33 (see FIG. 6).

The limit switch 29 ceases to deliver the stop command signal when the stopper member 34 is moved away from the inner surface of the slit 33*a* toward the region under the cage 2 after the switch 29 once delivers the stop command signal to the control device 21 as the driving lever 41 is shifted.

Preferably, the limit switch 29 should be provided with a display, such as an illuminant 53 shown in FIG. 4 that glows as it delivers the stop command signal. In this case, an operator or the like can easily visually determine whether or not the stop command signal is delivered from the switch 29.

On the other hand. the control device 21 is a processor provided with a microprocessor or the like, and serves to control the whole elevator apparatus. The control device 21 includes a drive unit stop command section 54 for stopping the drive unit 9 and a drive unit operation prohibiting section 55 for maintaining the stop state of the drive unit 9.

The command section 54 disconnects the drive unit 9 from the power supply in response to the stop command signal from the limit switch 29. Once the command section 54 cuts off the power supply, prohibiting section 55 maintains the resulting state.

Thus, even when the limit switch 29 ceases to deliver the stop command signal, the prohibiting section 55 keeps the drive unit 9 disconnected from the power supply and stopped until the reset switch 18 is operated.

When the operator operates the reset switch 18 (drive unit operation prohibition canceling means) to apply a canceling command signal to the input of the control device 21, the device 21 supplies electric power to the drive unit 9, thereby enabling the elevator apparatus to be restarted.

Thus, summarizing the restarting of the elevator apparatus, first, the cage 2 is pulled up, for example, to release the guide rail 5 from the hold between the stopper member 34 and the slit 33*a,* thereby removing the restraint of the emergency stop mechanism 14 on the up-and-down motion of the cage 2. When the mechanism 14 is released in this manner, the contact 52 of the limit switch 29 is reset to its initial state, so that the switch 29 ceases to deliver the stop command signal. In this state, however, the drive unit 9 is disabled by the action of the prohibiting section 55.

Figure 2B:
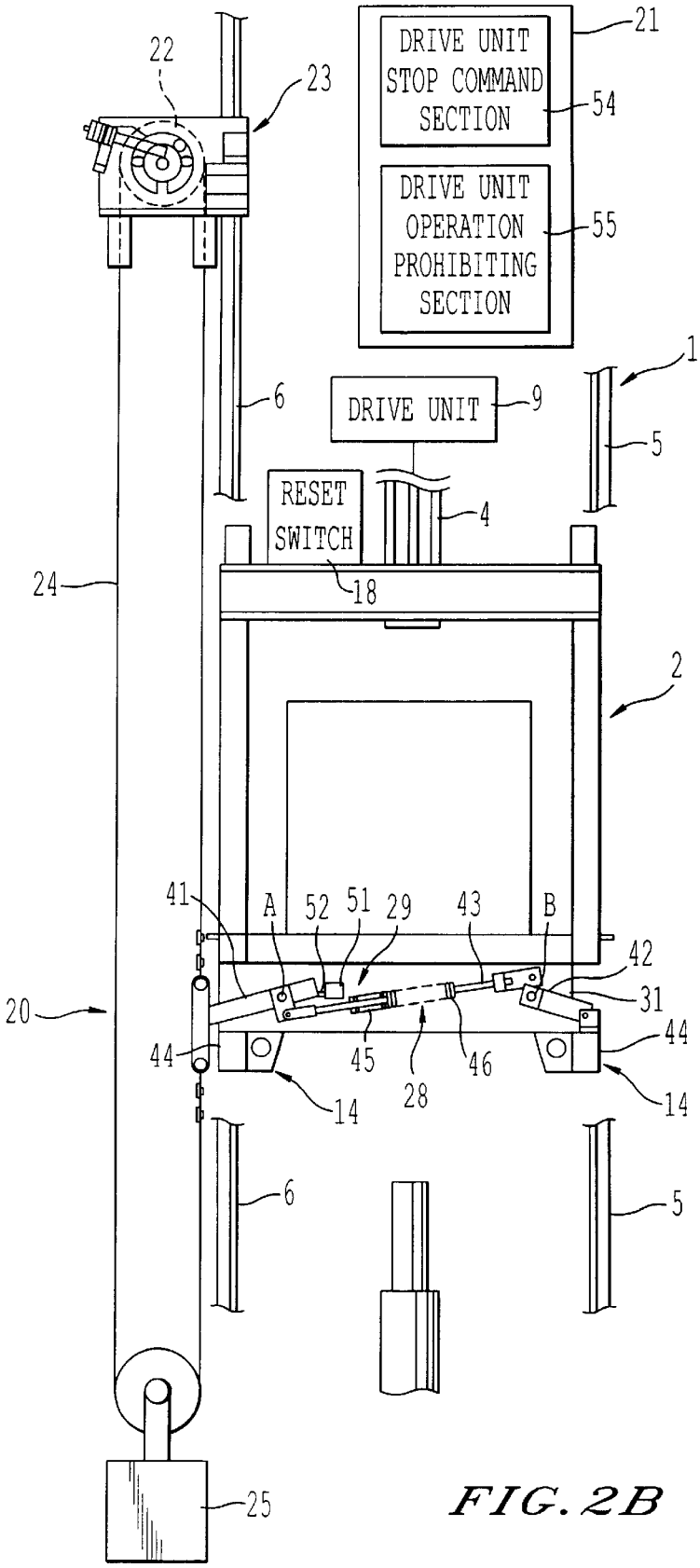

Thereupon, the operator carries out various inspections and then operates the reset switch 18 to enable restart of the drive unit 9. The switch 18 is set on a control panel in the door box of a hall door 47 on the uppermost floor, for example. Alternatively, the reset switch 18 is located at an upper end portion of the cage as shown in FIG. 2B.

Since the link mechanism 28 can be located at the lower end portion of the cage 2, moreover, it can be in an assembled state when it is shipped from the factory. Thus, the installation cost can be lowered.

The limit switch 29 delivers the stop command signal immediately before the emergency stop mechanisms 14 restrain the cage 2 from moving. If the mechanisms 14 operate wrongly due to vibration attributable to ascent or descent of the cage 2, for example, the drive unit 9 can be prevented from being actuated to loosen the cable 4 that suspends the cage 2 or to cause the cable 4 to slip out of a traction sheave of the drive unit 9.

Since the connecting rod 43 that connects the two emergency stop mechanisms 14 is guided in axial slide by the guide member 45, moreover, the mechanisms 14 can securely operate in association with each other.

Figure 7:
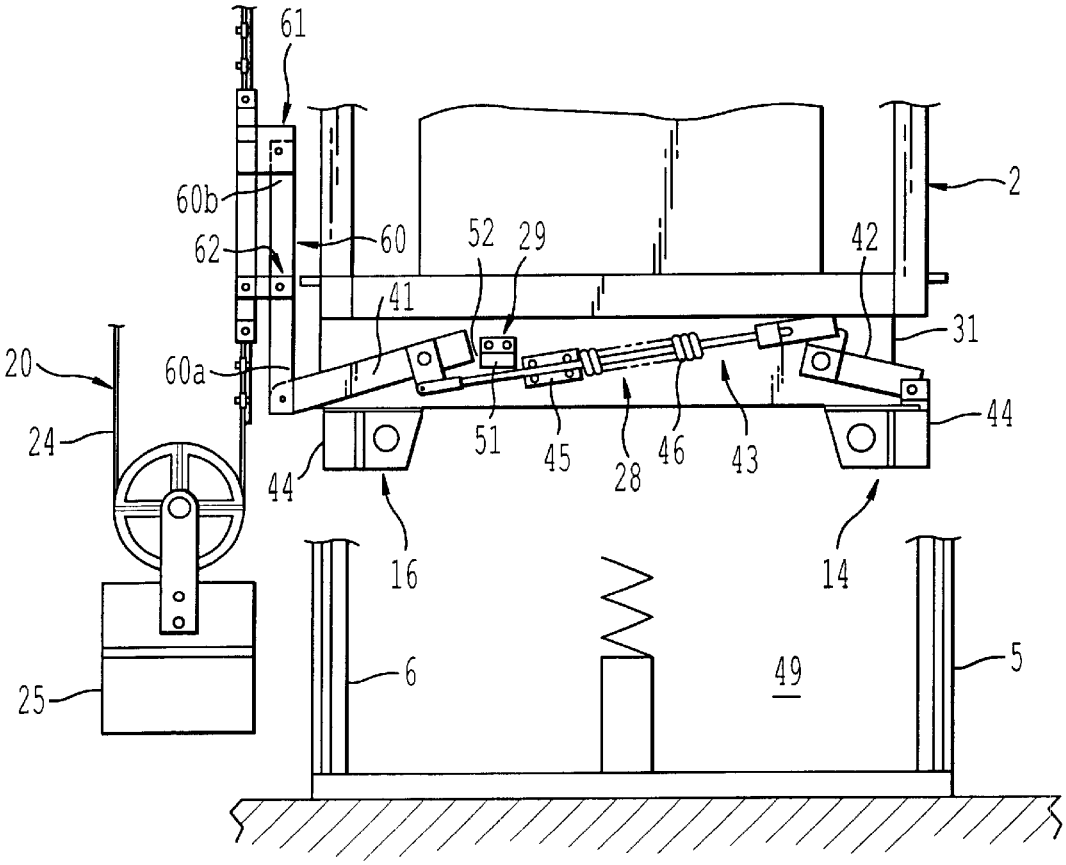
FIG. 7 is a side view showing a portion of the emergency stop device of an elevator apparatus according to a second embodiment of the invention.
Figure 8:
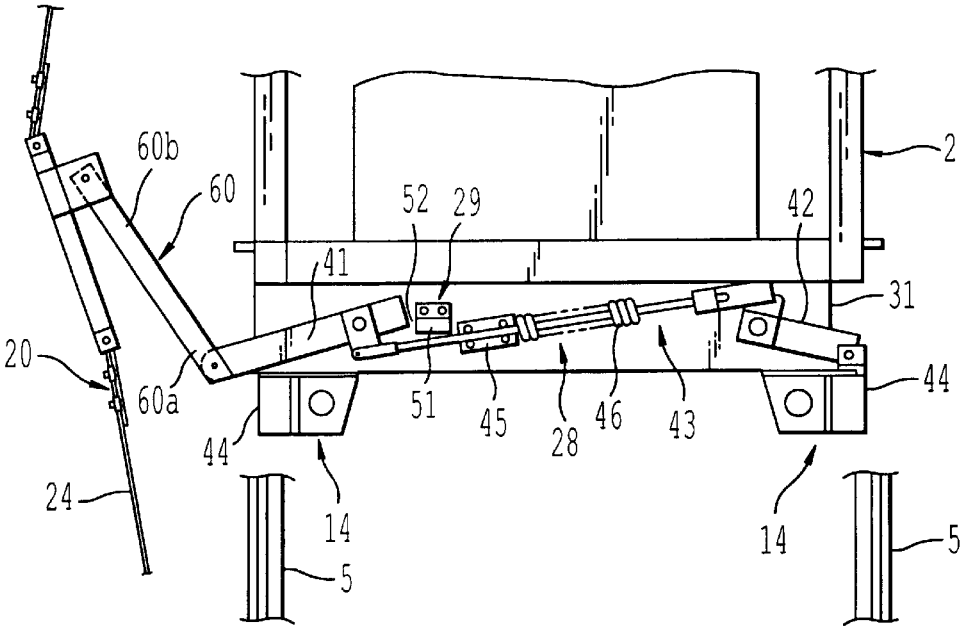
FIG. 8 is a side view showing a modification of the elevator apparatus according to the second embodiment.

FIGS. 7 and 8 show a second embodiment of the invention, wherein a driving lever 41 of a link mechanism 28 is connected to a governor cable 24 by means of an extension lever 60. The lever 60 is a belt-shaped plate, one end portion 60*a* of which is rockably connected to the driving lever 41, and the other end portion 60*b* of which extends above the one end portion 60*a* and is rockably connected to the cable 24 in a position higher than the position of connection with the lever 41.

Preferably, the extension lever 60 should be connected to the governor cable 24 by means of a first connecting portion 61 at the other end portion 60*b* and a second connecting portion 62 at the central portion, as shown in FIG. 7. The first and second connecting portions 61 and 62 connect the lever 60 and the cable 24 for rocking motion.

According to the second embodiment, the driving lever 41 of the link mechanism 28 is connected to the governor cable 24 by means of the extension lever 60 that extends vertically from the lever 41. Accordingly, a space 49 between the cage 2 at its bottom dead center and the floor surface of the elevator shaft 1 can be restricted. Thus, the depth of a pit for the shaft 1 can be reduced, so that the construction cost of the elevator apparatus can be restrained from increasing.

In the case where the extension lever 60 and the governor cable 24 are connected to each other by means of the first and second connecting portions 61 and 62 that are rockable, as shown in FIG. 7, the lever 60 can be prevented from falling so that erroneous operation of the emergency stop device is securely prevented if the lever 60 is urged to fall by a tension on the cable 24 and the mass of the lever 60, as shown in FIG. 8.

Numerous modifications and variations of the present invention are possible in light of the above teachings. It is therefore to be understood that within the scope of the appended claims the present invention can be practiced other than as specifically described herein.

What is claimed as new and desired to be secured by Letters Patent of the United States is:

1. An elevator comprising:

plural guide rails;

a cage configured to ascend and descend along at least one of said guide rails in an elevator shaft;

an emergency stop device configured to urgently stop said cage when said cage descend at an extraordinary speed, said emergency stop device including, an emergency stop mechanism provided at a lower end portion of said cage and configured to engage said at least one of said guide rails, thereby urgently stopping said cage, a link mechanism, provided at the lower end of said cage, coupled to said emergency stop mechanism and configured to actuate said emergency stop mechanism on receiving an external input;

a limit switch including, a contact that normally projects from, and draws backs into a body when said emergency stop device operates, and a display mounted to said body and configured to illuminate during said emergency stop device operating;

a speed detector configured to detect the descent of said cage at the extraordinary speed and correspondingly to apply said external input to said link mechanism;

wherein said emergency stop device further comprises:

the contact of said limit switch coupled to said link mechanism and said limit switch configured to detect the operation of said link mechanism for urgently stopping said cage, drive unit prohibiting means for prohibiting the operation of said drive unit in accordance with the result of detection by said limit switch, and operation prohibition canceling means for canceling the prohibition on the operation of said drive unit by said drive unit operation prohibiting means.

2. The elevator as recited in claim 1, wherein:

said operation canceling means is located in a position accessible from an elevator hall.

3. The elevator as recited in claim 1, wherein:

said drive unit is fixed to one of said guide rails in said elevator shaft.

4. The elevator as recited in claim 1, wherein:

said speed detector is fixed to one of said guide rails in said elevator shaft.

5. The elevator as recited in claim 1, wherein:

said operation prohibition canceling means is located at an upper end portion of said cage.

6. The elevator as recited in claim 1, wherein said speed detector comprises:

a cable connected to said link mechanism and capable of normally moving at the same speed as said cage; and a cable binding mechanism configured to bind said cable when said cage descends at the extraordinary speed.

7. The elevator as recited in claim 6, wherein said emergency stop device further comprises:

a connecting member having one end connected to said link mechanism and another end connected to said cable, the other end connected to said cable being in a position vertically higher than a position of connection of said one end connected to said link.

8. The elevator as recited in claim 6, comprising:

a pair of said emergency stop mechanisms provided at each of two opposite side portions of said cage; and said link mechanism comprising, a driving lever configured to actuate one emergency stop mechanism, a driven lever configured to actuate the other emergency stop mechanism, and a connecting rod which connects said driving lever to said driven lever.

9. The elevator as recited in claim 8, wherein said link mechanism comprises:

a guide member configured to restrict movement of said connecting rod only to an axial direction of the connecting rod.

10. The elevator as recited in claim 8, wherein said link mechanism comprises:

an urging member attached to said connecting rod and configured to urge said driving lever and said driven lever in a direction to cancel an emergency stop state.

* * * * *